US006125311A

United States Patent [19]

Lo

[11] Patent Number: 6,125,311

[45] Date of Patent: Sep. 26, 2000

[54] RAILWAY OPERATION MONITORING AND DIAGNOSING SYSTEMS

[75] Inventor: James Ting-Ho Lo, Howard County, Md.

[73] Assignee: Maryland Technology Corporation, Ellicott City, Md.

[21] Appl. No.: 09/001,662

[22] Filed: Dec. 31, 1997

[51] Int. Cl.[7] ..... G06F 17/00; G06F 19/00

[52] U.S. Cl. ..... 701/29; 701/19

[58] Field of Search ..... 701/19, 35, 29; 246/167 R, 169 R

[56] References Cited

U.S. PATENT DOCUMENTS

| | | | |
|---|---|---|---|
| 4,041,283 | 8/1977 | Mosier | 701/20 |
| 4,853,883 | 8/1989 | Nickles et al. | 395/500.29 |
| 5,390,883 | 2/1995 | Songhurst | 248/74.3 |
| 5,623,413 | 4/1997 | Matheson et al. | 701/117 |
| 5,828,979 | 10/1998 | Polivka et al. | 701/117 |
| 5,956,664 | 9/1999 | Bryan | 702/184 |

*Primary Examiner*—Michael J. Zanelli

[57] ABSTRACT

To enhance the safety and security of the operation of a railway network, a railway operation monitoring and diagnosing system is disclosed that monitors and diagnoses the entire railway network as an integrated system. The railway operation monitoring and diagnosing system comprises a railway operation predictor and a diagnosing means. The railway operation predictor generates anticipated values of selected railway operation state (ROS) variables. ROS variables may discrete or continuous. If there are continuous ROS variables selected, the railway operation predictor also determines the safety intervals of these continuous ROS variables. The diagnosing means examines the measured values of the selected ROS variables versus their anticipated values and/or safety intervals to detect and diagnose their discrepancies. A heuristics, statistics, fuzzy logic, artificial intelligence, neural network, or/and expert system is included in the diagnosing means for diagnosing the records of such discrepancies. If necessary, the railway operation predictor generates pessimistically anticipated values of a plurality of selected ROS and possibly other variables for further diagnosing the railway operation. The diagnosing means issues a diagnosis report and/or a recommendation, whenever the diagnosing means decides that such an issuance is appropriate.

18 Claims, 3 Drawing Sheets

RAILWAY OPERATION MONITORING AND DIAGNOSING SYSTEMS

BACKGROUND OF THE INVENTION

This invention is concerned mainly with monitoring and diagnosing the operation of a railway/guideway network to enhance the safety and security of the same. Comprising at least one track/guideway and one vehicle for transportation on it, a railway/guideway network is herein referred to as a railway network.

Safety is undoubtedly the foremost consideration in the operation of a railway network. Many safety features can be found in railway equipment and devices. Among the large number of patents concerning such safety features, the three that are believed to be most closely related to the invention disclosed herein are U.S. Pat. No. 4,133,505, U.S. Pat. No. 4,284,256, and U.S. Pat. No. 4,096,990. However, none of them is concerned with monitoring and diagnosing the entire operation of a railway network.

As the activities in a railway network are closely interdependent, a system that comprehensively monitors and diagnoses the entire operation of a railway network is much needed. In response to such a need, a novel railway operation monitoring and diagnosing system (ROMADS) is herein disclosed, which uses mainly the information available in most existing railway networks to monitor and diagnose the railway operation, and if so decided, issue an alert and/or a recommendation for remedial action.

SUMMARY

To enhance the safety and security of the operation of a railway network, a railway operation monitoring and diagnosing system is herein disclosed that monitors and diagnoses the entire railway network as an integrated system. The railway operation monitoring and diagnosing system comprises a railway operation predictor and a diagnosing means. The railway operation predictor generates the anticipated values of the railway operation state (ROS) variables in a selected railway operation state. If there are continuous ROS variables, the railway operation predictor also determines the safety intervals of the continuous ROS variables. The diagnosing means examines the measured values of the ROS variables versus their anticipated values and safety intervals for each detection time to detect and diagnose their discrepancies for the ROS variables for said detection time.

If the actual normal values of a variable are determined by interaction between at least one signal or/and control system and at least one train, the anticipated values of the variable are generated by the railway operation predictor through simulating this interaction, with the use of the anticipated values of the locations of said at least one train. The anticipated value of the location of a train for a time is the predicted value of this location given the measured values of the locations of said at least one train up to and including said time.

The diagnosing means diagnoses the discrepancies for the ROS variables by examining the records of such discrepancies and decides whether and what to issue—a diagnosis report, a recommendation for a remedial action, or a request for further diagnosis. A heuristics, statistics, fuzzy logic, artificial intelligence, neural network, or/and expert system is included in the diagnosing means for diagnosing these records of discrepancies.

If necessary, the railway operation predictor generates pessimistically anticipated values of a plurality of the ROS and possibly other variables for further diagnosing the railway operation.

DESCRIPTION OF THE DRAWINGS

FIG. 3 is essentially the same as FIG. 2 except that the pessimistically anticipated values of some or all ROS variables are calculated 35 by the railway operation predictor 5 and used in the discrepancy diagnosis 25 by the diagnosing means 10. The calculation of the pessimistically anticipated values of the ROS variables is initiated by the diagnosing means whenever the need arises.

DESCRIPTION OF PREFERRED EMBODIMENTS

Railway Operation State Variables

A railway network comprises at least one track/guideway and one vehicle for transportation on it. Every such a vehicle is referred to as a train. For instance, a service vehicle, manned or unmanned, large or small, is regarded ad a train. A railway operation state (ROS) is a vector whose components are variables that reflect the operational safety of a railway network. The component variables of an ROS are selected from existing variables, new variables and/or combinations of existing and new variables. The dimension of the ROS may change from time to time. For instance, if the number of trains whose locations are selected as components of the ROS changes from time to time, the dimension of the ROS changes accordingly. Examples of existing variables are 1. the locations, speeds and accelerations of trains;
2. the signals and commands determined by interaction between at least one train and at least one railway signal and/or control system, by a dispatcher making manual dispatch decisions, or by a computer program performing adaptive or automatic dispatching;

3. the states of track elements such as track switches and track signals;
4. the power consumptions at the metering points and the voltages and currents at salient points in the electrical network;
5. the status variables including field alarm points such as fire, door entry, power loss, battery charger failure, temperature alarm on transformer, etc.;
6. all the commands that go from train operators to the field such as loss of train ID, communication loss, software failure, signal failure, etc.;
7. all the alarms that are displayed at all consoles and when an operator acknowledges or retires an alarm (both field and software generated alarms); and
8. alarms that are generated by the host computer operating system in a centralized traffic control system such as disk failure, low memory, etc.

The selected variables constitute the ROS and are called ROS variables. If the possible values of an ROS variable (e.g., signals, commands and indicators) are from a finite set of numbers such as the set of binary numbers "1" and "0," the ROS variable is called a discrete ROS variable. Otherwise, the ROS variable (e.g., train locations and speeds) is called a continuous ROS variable.

Measured Values

Measurements of the actual values of the ROS and possibly other variables are taken from the railway network and called their measured values. All the measured values are not necessarily taken at the same times. For instance, the location of a train may be measured and reported more often than other variables. However, it is assumed for simplicity of our description that all the measured values of ROS and possibly other variables at a certain sequence of time points are available. Every time point for which a measured value of an ROS is taken is called a detection time.

Railway Operation Predictor

Figure 1:
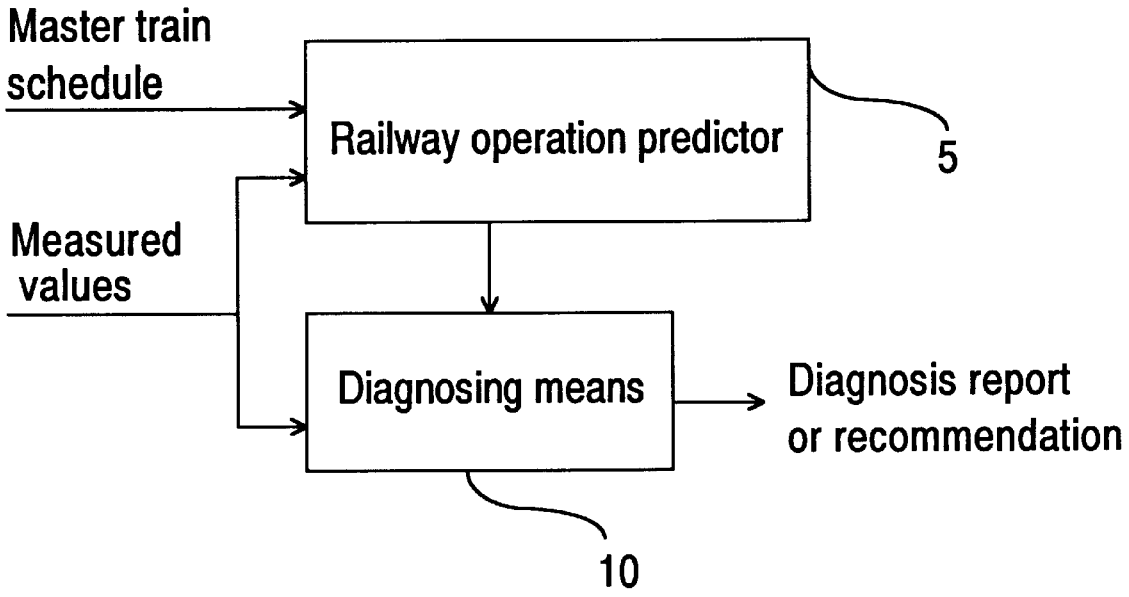
FIG. 1 is a schematic diagram of a railway operation monitoring and diagnosing system herein disclosed. The railway operation monitoring and diagnosing system comprises a railway operation predictor 5 and a diagnosing means 10. The railway operation predictor 5 inputs a continuously updated master train schedule (or its updates data) and the measured values of the railway operation state (ROS) variables and possibly other variables. Using the measured values and the outputs from the railway operation predictor 5, the diagnosing means 10 decides whether and what to issue—a diagnosis report, a recommendation for a remedial action, or a request for further diagnosis.
Figure 2:
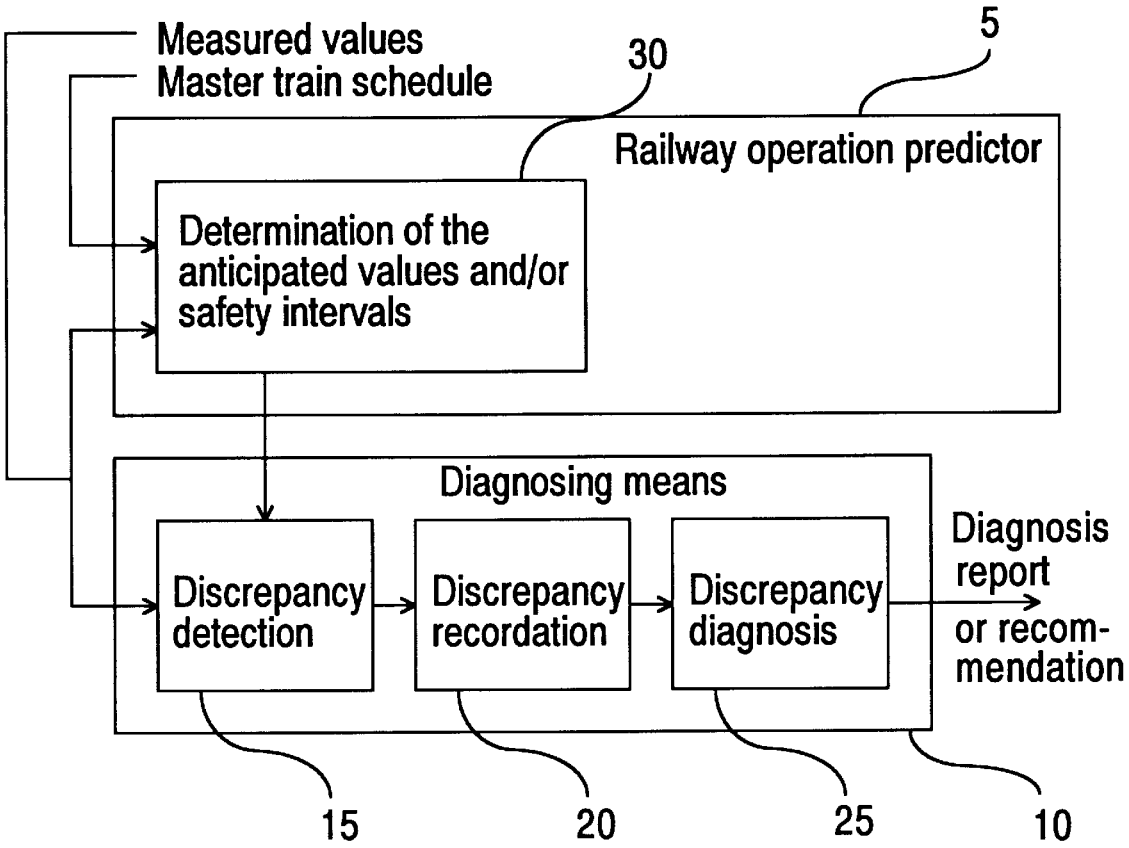
FIG. 2 is a schematic diagram of a railway operation monitoring and diagnosing system herein disclosed. The railway operation monitoring and diagnosing system comprises a railway operation predictor 5 and a diagnosing means 10. The railway operation predictor 5 inputs a continuously updated master train schedule (or its updates data) and the measured values of the railway operation state (ROS) and possibly other variables, and calculates 30 and outputs the anticipated values of the ROS variables. If some of the ROS variables are continuous ROS variables, the railway operation predictor also calculates and outputs the safety intervals of these continuous ROS variables. Using the measured values and the outputs from the railway operation predictor, the diagnosing means 10 performs essentially three functions, discrepancy detection 15, discrepancy recordation 20, and discrepancy diagnosis 25. The discrepancy diagnosis 25 decides whether and what to issue—a diagnosis report, a recommendation for a remedial action, or a request for further diagnosis.
Figure 3:
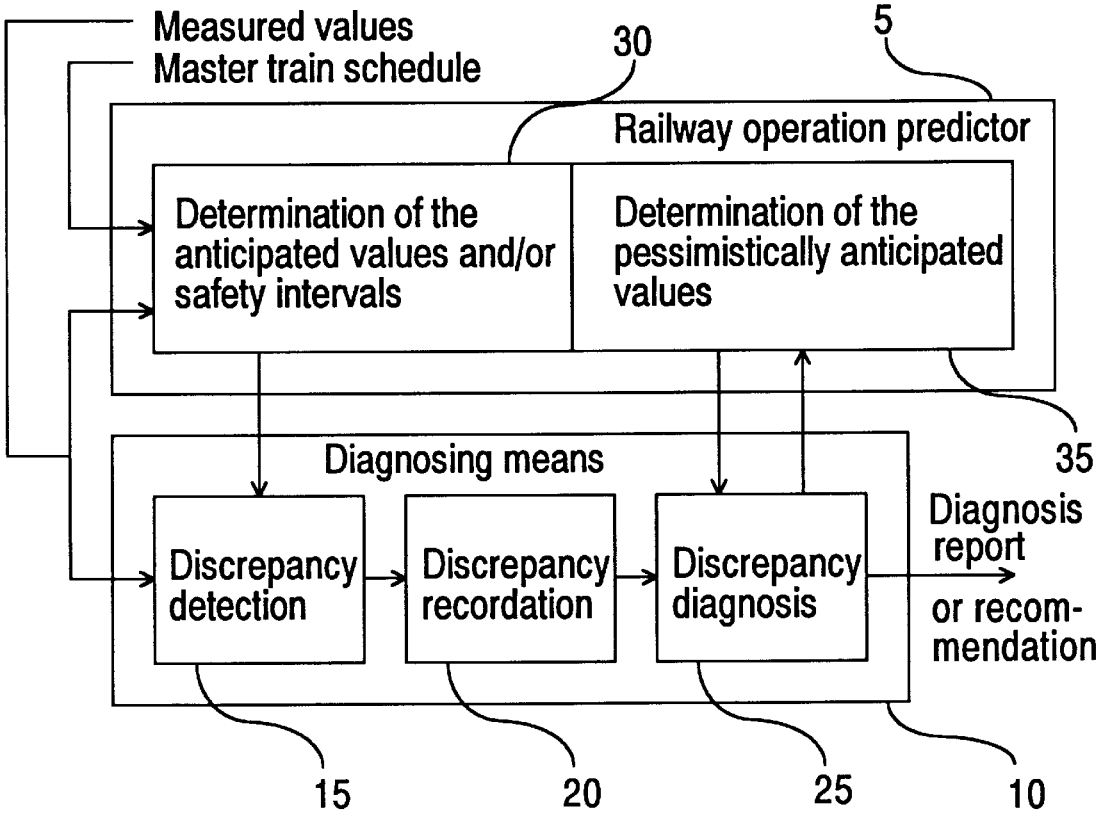
FIG. 3 is a schematic diagram of a railway operation monitoring and diagnosing system herein disclosed.

The railway operation monitoring and diagnosing system (ROMADS) herein disclosed comprises a railway operation predictor 5 and a diagnosing means 10, as shown in FIG. 1, FIG. 2 and FIG. 3. In similarity with railroad operation simulators, a railway operation predictor contains some data on the signal and/or control systems for controlling and/or directing the operations of trains on the railway network and some data for describing tracks or guideways including locations of stations and stops and is capable of simulating the functions of switches, controls and signals with or without interaction with trains. As opposed to railway operation simulators, the railway operation predictor for our ROMADS interacts closely with the real railway network through the use of a master train schedule and the measured values of the ROS and possibly other variables and is only required to generate anticipated and pessimistically anticipated values and safety intervals of all or some of the ROS and possibly other variables. The anticipated and pessimistically anticipated values and safety intervals are defined in the sequel. Although some of the commercially available railway simulators can be modified and adapted into a railway operation predictor for use in our ROMADS, a railway operation predictor specially developed for efficient and effective use in our ROMADS is highly desirable.

A typical railway operation predictor for our ROMADS contains the track network layout, entry points into the network, locations and lengths of blocks, parallel track connections, switch locations and positions, track grades, track curves, direction of permitted travel, speed limits, signal locations, signal characteristics, signalling and control logic, normal and abnormal trajectories of the train locations and/or speeds as functions of time, etc.

The normal and abnormal trajectories of the train locations and/or speeds as functions of time, which are used to predict the train locations and/or speeds, are obtained by a train performance simulator using routing information, track curves, track grades, speed constraints, number and types of locomotives and cars, motive powers, tractive and braking effort curves, train resistance information, the lengths, empty and full weights of cars, train IDs, track and train data for computing the train resistance for each train, acceleration and braking rates, etc. A good description of a train performance simulator can be found in Jane Lee-Gunther, Mickie Bolduc and Scott Butler, "*Vista*™ Rail Network Simulation," *Proceedings of the* 1995 *IEEE/ASME Joint Railroad Conference*, edited by W. R. Moore and R. R. Newman, pp. 93–98, Baltimore, Md. (1995); and R. A. Uher and D. R. Disk, "A Train Operations Computer Model," *Computers in Railway Operations*, pp. 253–266, Springer-Verlag, New York (1987).

A master train schedule and measured values of the ROS and possibly other variables are input to and/or maintained in the railway operation predictor. The master train schedule is a comprehensive schedule of all the events and activities that the railway network authority plans and that affect, directly or indirectly, the values of the ROS variables. The master train schedule is also called the master operation schedule and master schedule. Any authorized change or changes of the master train schedule including commands and control signals that affect the values of the ROS variables are immediately incorporated into the master train schedule in the railway operation predictor. For instance, if an unplanned delay of a train causes a central traffic control to change the schedules of this and other trains, these changes should immediately be incorporated in the master train schedule. The master train schedule includes information on the scheduled initial location, speed, and time for the entry of each train into the track network. Using the master train schedule and the measured values of ROS and possibly other variables for a time t as the initial operating conditions and/or constrains, the railway operation predictor is capable of predicting the location, speed, route of each train; and the ROS and possibly other variables (e.g., status of switches, blocks, signals) for the next time the measured values become available or/and as functions of time from the time t onward.

If the power distribution systems are to be monitored and diagnosed as well, such data about the power distribution system as the running rail impedances; power rail catenary or trolley impedances; substation locations and characteristics; nominal, maximum and minimum operating voltages; train power consumptions as functions of train locations, speeds and accelerations; and/or metering point locations are also contained in the railway operation predictor. Using the master train schedule and the measured values of the relevant variables as the initial operating conditions and/or current operating constrains, the railway operation predictor is also capable of predicting such variables in the power distribution system as the power flows, voltages, currents and losses at salient points, that are selected as ROS variables, for the next time the measured values come in or/and as functions of time.

Anticipated Values

The railway operation predictor generates "anticipated" values 30 of the ROS and possibly other variables for each detection time. The anticipated value of a variable for a detection time t is determined, using the master train schedule and the measured and anticipated values of some ROS and possibly other variables for up to and including time t, under the assumption that no unexpected or abnormal event starts to occur between this detection time t and its preceding detection time. Some guidelines for determining anticipated values are given as follows:

1. The location and/or speed of each train to be monitored are usually chosen as ROS variables. If so, since the number of trains to be monitored may change from time to time, the total number of ROS variables is not a constant. Whether the location and/or speed of a train are ROS variable or not, the anticipated values of them are usually required to calculate the anticipated values of other variables. The railway operation predictor uses the master train schedule and the last measured values of the train location(s) and/or speed(s) up to and including the detection time t to estimate the actual values of these variables for the time t. The estimated values thus obtained are called the predicted values of these variables for the time t and are used as their anticipated values for the same time. Notice that if the measured values of these train location(s) and/or speed (s) for t are available, these measured values are the predicted and anticipated values of these variables for the same time t. If not, only short-term prediction(s) of the train location(s) and/or speed(s) for t are usually needed. Modern technology such as GPS and differential GPS receivers has made measuring the train locations and speeds simple and accurate. For short-term prediction(s), extrapolation methods can be used, which are computationally less expensive than using the mentioned trajectories of the train locations and speeds as functions of time. A simple extrapolation method is simply to assume that the train runs at the last measured value of the train speed on the section of the track following the last measured value of the train position. The locations of the track sections on which measuring or reporting a train location and/or speed are difficult should be specified and stored in the railway operation predictor.
2. If in a normal operating condition, the actual value of a variable is determined by interaction between a train or trains and the signal and/or control systems, the railway operation predictor uses all the anticipated values of the train location(s), speed(s) and/or acceleration(s) up to and including t to simulate this interaction and generate the anticipated value of the variable for t.
3. If in a normal operating condition, the actual value of a variable is determined by the master train schedule, a central traffic control system, an authorized railway personnel, or an authorized computer program; the anticipated value of the variable for t is set to be the value of the variable for t determined or simulated in the same way.

Safety Intervals

The diagnosing means treats the discrete ROS variables and continuous ROS variables differently. For a continuous ROS variable, a safety interval for time t is first determined 30 using one or more measured, anticipated, scheduled, and/or other reference value(s) of the ROS and possibly other variables. Here the scheduled value for time t of a variable is defined to be a desired value of the variable according to the master train schedule up to and including time t. Of course, not every continuous variable has a scheduled value. An example of a continuous variable that has a scheduled value is the location of a train. The scheduled value of the train location for time t is determined from the master train schedule for time t with or without the use of the railway operation predictor. The safety interval of the train location encloses the scheduled value of the train location. It is determined by taking into consideration the master train schedule; the train's measured speed, braking rate and length; the train's headway; the accuracy of the scheduled value of the train location; anticipated values of the locations, speeds and/or accelerations of other trains; etc. Another example of a continuous variable is the speed of a train. The safety interval for time t of the train's speed is determined by considering the master train schedule; the train's measured location, braking rate and length; the train's headway; the speed limit; anticipated values of the locations, speeds and/or accelerations of other trains; etc. The determination of the safety intervals of the continuous ROS variables is regarded as a function of the railway operation predictor, which has all the information required for said determination.

Discrepancy Detection and Recordation

The diagnosing means first checks if the measured value for time t of each continuous ROS variable belongs to its safety interval for time t, and compares the measured and anticipated values for time t of each discrete ROS variable right after those values are received and generated respectively. If the measured value of a continuous ROS variable is found to fall outside its safety interval or if a difference is observed between the measured and anticipated values of a discrete ROS variable, we say that a discrepancy is detected 15. It is understood that using the difference between the measured value and some reference value of a continuous ROS variable to determine whether there is a discrepancy is equivalent to using a safety interval discussed above. For instance, a reference value of the location of a train is its scheduled value mentioned earlier.

If a discrepancy is detected between the measured value and the safety interval of a continuous ROS variable, the discrepancy is added to a record 20 of the discrepancies between the preceding measured values and safety intervals of the continuous ROS variable to form a new record for the continuous ROS variable. If a discrepancy is detected between the measured and anticipated values of a discrete ROS variable, the discrepancy is added to a record of the discrepancies between the preceding measured and anticipated values of the discrete ROS variable to form a new record for the discrete ROS variable.

The records of discrepancies for different ROS variables can be kept for different numbers of detection times, which may range from one to a large integer, depending on what are required for accurate discrepancy diagnosis and on the size of the memory allocated for discrepancy recordation. Usually the length of the record of discrepancies (in terms of the number of detection times) for an ROS variable that is required for accurate discrepancy diagnosis depends on the accuracy of the anticipated values of the ROS and possibly other variables, especially those of the train locations.

Discrepancy Diagnosis

As long as there is one discrepancy detected for a continuous or discrete ROS variable, a diagnosis 25 based on at least one of heuristics, statistics, fuzzy logic, neural network, artificial intelligence, and expert system is performed on the new records of the discrepancies. The performance of the diagnosis results usually in one of the following four outcomes:

1. If the heuristics, statistics, fuzzy logic, neural network, artificial intelligence, and/or expert system(s) decides that no action beyond the mentioned updating of the records of the discrepancies is necessary, the performance of the diagnosis is completed for the detection time.

2. If the heuristics, statistics, fuzzy logic, neural network, artificial intelligence, and/or expert system(s) decides that there is a danger or a significant evidence for danger in the railway operation, a diagnosis report and/or a recommendation for a remedial action(s) are immediately forwarded to the central traffic control, the involved train driver(s), other involved railway personnel and/or the involved computer program(s) for consideration and/or execution. Diagnosis report may simply be an alert with either the problem or the relevant ROS variables or both specified.
3. If the heuristics, statistics, fuzzy logic, neural network, artificial intelligence, and/or expert system(s) decides that the railway operation predictor is needed for further diagnosis, the railway operation predictor instantaneously (or faster than real time) generates a sequence, of a predetermined length, of pessimistically anticipated values 35 of some or all of the ROS variables and possibly other variables with the purpose of finding out whether there will be a dangerous (or undesirably) event forthcoming, what the event is, the degree of the seriousness of the event, the time and location of the event, and/or cause(s) of the new discrepancy records. To achieve this purpose, the faulty ROS variables for t, that are those ROS variables with a discrepancy for t, are assumed to continue being faulty, and all the other variables are assumed to be initially normal in the generation of the pessimistically anticipated values, which is based on the master train schedule for t and initialized with the measured values of the ROS and possibly other variables at t.

After the pessimistically anticipated values of some or all of the ROS variables and possibly other variables are generated and used in a further diagnosis. A diagnosis report and/or a recommendation for a remedial action based on these findings are then immediately forwarded to the central traffic control, the involved train driver(s), other involved railway personnel and/or the involved computer program(s) for consideration and/or execution.

4. If the heuristics, statistics, fuzzy logic, neural network, artificial intelligence, and/or expert system(s) decides that a diagnosis and/or judgement by a human or a system other than itself is required, a diagnosis report, including an evaluation request and relevant records of discrepancies are immediately made available to the designated railway personnel and/or system(s).

Step 3 above allows us to "look into the future" in diagnosing the discrepancies. However, the inclusion of step 3 is optional. The phrase "diagnosing the new records of discrepancies" is equivalent to the phrase "diagnosing the discrepancies."

After the diagnosis report and/or recommendation for a remedial action(s) are output, the railway operation predictor returns to the time t and from time t onward, generates the anticipated values of the ROS and possibly other variables and determines the safety intervals of the continuous ROS variables for each detection time, until another discrepancy for an ROS variable is detected by the diagnosing means.

At the time the ROMADS is initially deployed, the railway operation predictor is best "initialized" in a normal railway operation. In other words, it is best allowed to generate the anticipated values of the ROS and possibly other variables for each of a few consecutive detection times in a normal railway operation.

Generating Pessimistically Anticipated Values

As mentioned earlier, the faulty ROS variables for t, that are those ROS variables with a discrepancy for t, are assumed to continue being faulty, and all the other variables are assumed to be initially normal in the generation of the pessimistically anticipated values, which is based on the master train schedule for t and initialized with the measured values of the ROS and possibly other variables for t. Some guidelines for the generation of the pessimistically anticipated values are suggested in the following:

1. The pessimistically anticipated value of a faulty discrete ROS variable (e.g., signal or switch) for time $s \geqq t$ is set equal to its measured value for time t. The pessimistically anticipated value of a faulty continuous ROS variable other than the locations and speeds of trains for time s is set equal to the predicted value of the faulty continuous ROS variable for s obtained by the railway operation predictor using the master train schedule for time t, the pessimistically anticipated values of the faulty discrete ROS variables up to and including s, and the measured values of the faulty continuous ROS variables for time t.
2. In accordance with the pessimistically anticipated values of the faulty ROS variables (e.g., signals and switches) for time t, the railway operation predictor uses the master train schedule for time t, and the measured values of the train locations, speeds and/or accelerations for t to predict these continuous variables for the time s. The predicted values are used as the pessimistically anticipated values of these train locations, speeds and/or accelerations for time s.
3. If in a normal operating condition, the actual value of a variable, that is not a faulty ROS variable for time t, is determined by interaction between a train or trains with the signal and/or control systems, the railway operation predictor uses all the pessimistically anticipated values of the train(s)'s location(s), speed(s) and/or acceleration(s) up to and including s to simulate this interaction and generate the pessimistically anticipated value of the variable for s.
4. If in a normal operating condition, the actual value of a variable, that is not a faulty ROS variable for time t, is determined by the master train schedule, a central traffic control system, an authorized railway personnel, or an authorized computer program, the pessimistically anticipated value of the variable for s is set to be the value of the variable at the same time s determined in the same way by the railway operation predictor, using the pessimistically anticipated values of the faulty ROS variables for time t and the measured values of the ROS variables up to and including t.

CONCLUSION, RAMIFICATION, AND SCOPE OF INVENTION

It is understood that not all the features disclosed herein have to be included in an ROMADS, and that the features for inclusion should be selected to maximize the cost-effectiveness of the ROMADS. The disclosed ROMADS is applicable to railway networks of all sizes and complexities. A large and/or complex railway network can also be divided into overlapped smaller railway networks, each being monitored and diagnosed by an ROMADS herein disclosed.

While our descriptions hereinabove contain many specificities, these should not be construed as limitations on the scope of the invention, but rather as an exemplification of preferred embodiments. In addition to these embodiments, those skilled in the art will recognize that other embodiments are possible within the teachings of the present invention. Accordingly, the scope of the present invention should be limited only by the appended claims and their appropriately construed legal equivalents.

What is claimed is:

1. A system for monitoring and diagnosing an operation of a railway network, said system comprising a railway operation predictor for generating anticipated values of a plurality of discrete railway operation state variables; and diagnosing means for detecting and diagnosing discrepancies between anticipated values and measured values of said discrete railway operation state variables, wherein said diagnosing means compares anticipated values and measured values of said discrete railway operation state variables for a first detection time after said measured values for said first detection time are received by said diagnosing means; and if a discrepancy between said anticipated values and measured values for said first detection time is detected, said diagnosing means diagnoses said discrepancy.

2. The system in claim 1, wherein an anticipated value of a railway operation state variable for a second detection time is determined by using a master train schedule and measured and anticipated values of at least one railway operation state variable for up to and including said second detection time, under the assumption that no unexpected or abnormal event starts to occur between two consecutive detection times ending at said second detection time.

3. The system in claim 1, wherein an anticipated value of a train's location for a third time is a predicted value of said location given measured values of said train's locations for up to and including said third time.

4. The system in claim 3, wherein anticipated values of at least one of said discrete railway operation state variables are generated by said railway operation predictor through simulating, with the use of anticipated values of locations of at least one train, interaction between said at least one train and at least one of signal and control systems.

5. The system in claim 1, wherein a record of discrepancies for at least one of said discrete railway operation state variables is maintained.

6. The system in claim 5, wherein said diagnosing means examines said record of discrepancies in diagnosing discrepancies for said at least one of said discrete railway operation state variables.

7. The system in claim 6, wherein at least one of heuristics, statistics, fuzzy logic, artificial intelligence, neural network, and expert systems is used in diagnosing said record of discrepancies.

8. The system in claim 1, wherein said railway operation predictor is also for generating pessimistically anticipated values of at least one of said discrete railway operation state variables for further diagnosing a discrepancy.

9. A system for monitoring and diagnosing an operation of a railway network, said system comprising a railway operation predictor for generating anticipated values of a plurality of discrete railway operation state variables and determining safety intervals of a plurality of continuous railway operation state variables; and diagnosing means for detecting and diagnosing discrepancies between anticipated values and measured values of said discrete railway operation state variables and for detecting and diagnosing discrepancies between safety intervals and measured values of said continuous railway operation state variables, wherein said diagnosing means compares anticipated values and measured values of said discrete railway operation state variables for a first detection time and compares safety intervals and said measured values of said continuous railway operation state variables for said first detection time after said measured values for said first detection time are received by said diagnosing means; if a first discrepancy is detected between said anticipated values and measured values of said discrete railway operation state variables for said first detection time, said diagnosing means diagnoses said first discrepancy; and if a second discrepancy is detected between said safety intervals and measured values of said continuous railway operation state variables for said first detection time, said diagnosing means diagnoses said second discrepancy.

10. The system in claim 9, wherein an anticipated value of a railway operation state variable for a second detection time is determined by using a master train schedule and measured and anticipated values of at least one railway operation state variable for up to and including said second detection time, under the assumption that no unexpected or abnormal event starts to occur between two consecutive detection times ending at said second detection time.

11. The system in claim 9, wherein at least one of said continuous railway operation state variables is a variable in a power distribution system.

12. The system in claim 9, wherein an anticipated value of a location of a train for a third time is a predicted value of said location given measured values of said train's locations up to and including said third time.

13. The system in claim 12, wherein anticipated values of at least one of said discrete railway operation state variables are generated by said railway operation predictor through simulating, with the use of anticipated values of locations of at least one train, interaction between said at least one train and at least one of signal and control systems.

14. The system in claim 9, wherein at least one train's location is a continuous railway operation state variable, and a safety interval of said location is determined with the use of a master train schedule.

15. The system in claim 9, wherein a record of discrepancies for at least one of said railway operation state variables is maintained.

16. The system in claim 15, wherein said diagnosing means examines said record of discrepancies in diagnosing discrepancies for said at least one of said railway operation state variables.

17. The system in claim 16, wherein at least one of heuristics, statistics, fuzzy logic, artificial intelligence, neural network, and expert systems is used in diagnosing said record of discrepancies.

18. The system in claim 9, wherein said railway operation predictor is also for generating pessimistically anticipated values of at least one of said railway operation state variables for further diagnosing a discrepancy.

* * * * *